US008677910B2

(12) United States Patent
Yu et al.

(10) Patent No.: US 8,677,910 B2
(45) Date of Patent: Mar. 25, 2014

(54) EXTENDIBLE TABLE

(75) Inventors: Arry Shin Yu, Seattle, WA (US); Jeffrey Bannister Fernald, Seattle, WA (US)

(73) Assignee: Arry Yu, Seattle, WA (US)

( * ) Notice: Subject to any disclaimer, the term of this patent is extended or adjusted under 35 U.S.C. 154(b) by 326 days.

(21) Appl. No.: 12/885,197

(22) Filed: Sep. 17, 2010

(65) Prior Publication Data

US 2012/0067254 A1 Mar. 22, 2012

(51) Int. Cl.
*A47B 5/00* (2006.01)

(52) U.S. Cl.
USPC ..... 108/48; 108/134

(58) Field of Classification Search
USPC ..... 108/38, 42, 48, 137, 134, 135, 152, 108/143, 102; 38/137; 312/246, 313, 314, 312/317.1, 317.3
See application file for complete search history.

(56) References Cited

U.S. PATENT DOCUMENTS

| | | | | |
|---|---|---|---|---|
| 1,852,357 | A * | 4/1932 | Merhar | 108/149 |
| 2,616,774 | A * | 11/1952 | Prince | 108/38 |
| 3,565,501 | A * | 2/1971 | Bowen et al. | 312/228 |
| 3,760,744 | A * | 9/1973 | Cruckshank | 108/64 |
| 4,500,146 | A * | 2/1985 | Peterson | 312/257.1 |
| 4,713,949 | A * | 12/1987 | Wilcox | 68/235 R |
| 5,322,022 | A | 6/1994 | Burkholder | |
| 6,193,062 | B1 * | 2/2001 | Rysgaard et al. | 206/315.11 |
| 6,219,866 | B1 * | 4/2001 | Pascal | 5/655 |
| 6,327,985 | B1 * | 12/2001 | Frenkler et al. | 108/147.19 |
| 6,637,350 | B2 * | 10/2003 | McKsymick | 108/25 |
| 7,007,614 | B2 * | 3/2006 | Gaunt et al. | 108/102 |
| 2009/0001037 | A1 * | 1/2009 | Wilcock | 211/119.003 |
| 2009/0223417 | A1 | 9/2009 | Muirhead | |

FOREIGN PATENT DOCUMENTS

| | | |
|---|---|---|
| JP | 1992-105604 | 4/1992 |
| JP | 07-308225 | 11/1995 |

* cited by examiner

*Primary Examiner* — Janet M Wilkens
(74) *Attorney, Agent, or Firm* — ÆON Law; Adam L. K. Philipp

(57) ABSTRACT

Provided herein are extendible table apparatuses.

15 Claims, 10 Drawing Sheets

EXTENDIBLE TABLE

FIELD

The present disclosure relates to tables, and more particularly, to a table with a continuously extendible surface.

BACKGROUND

A table is a type of furniture comprising an open, flat surface supported by a base or legs. Tables are often used to hold articles (e.g., dishware, papers, books, and the like) at a convenient height when sitting, and are therefore often used in conjunction with one or more chairs. A table specifically intended for writing and office work is commonly referred to as a desk.

Many tables are placed in living and/or working spaces in which space is at a premium. Furthermore, in many cases, a table user might have a need for a large table only occasionally (e.g., when visitors need to be seated at the table), needing only a smaller tabletop on a day to day basis. Consequently, some tables have removable sections or leaves used to extend the surface in discrete increments. Other tables may utilize hinged extensions of the table top (commonly known as "drop leaves"). However, removable leaves can be difficult to install, and some require an external storage space to house the leaves when not in use. Drop leaves do not share these disadvantages, but drop leaves can interfere with use of the table when they are in their dropped position.

Many tables are also placed in multi-purpose spaces, in which some uses of the space may be more efficient without the table being present. In some cases, such multi-purpose spaces may sometimes house a portable folding table, in which the legs fold up against the underside of the table top for storage when not in use. However, many folding tables are not aesthetically pleasing. In addition, folding tables require storage space when they are not in use. Some folding tables may be light and/or easy to deploy, but suitable only for supporting light-weight articles. Other folding tables may be sturdier, but heavy and/or difficult to deploy.

DESCRIPTION

Figure 1:
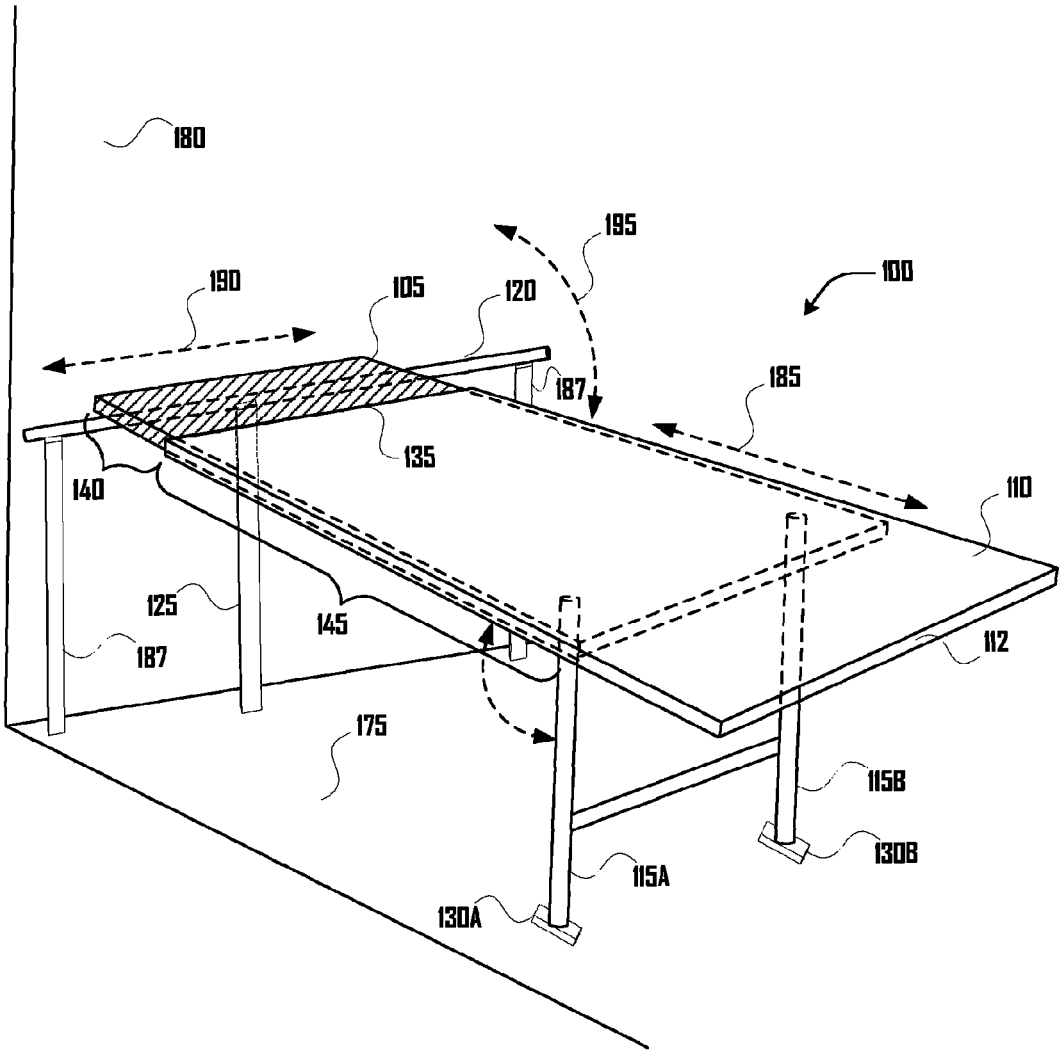
FIGS. 1-3 illustrate an exemplary extendible table in accordance with various embodiment.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications, and equivalents. In alternate embodiments, additional devices, or combinations of illustrated devices, may be added to, or combined, without limiting the scope to the embodiments disclosed herein.

FIG. 1 illustrates an exemplary extendible table 100 in accordance with one embodiment. Extendible table 100 includes a lower tabletop 105 and an upper tabletop 110 configured to slide across lower tabletop 105 along an extension path 185. Lower tabletop 105 and upper tabletop 110 form in combination a combined tabletop surface that may be extended horizontally as upper tabletop 110 slides along extension path 185.

An edge 135 of upper tabletop 110 delineates portions 140 and 145 of lower tabletop 105. Portion 145 of lower tabletop 105 overlaps with a portion of upper tabletop 110, while portion 140 of lower tabletop 105 does not overlap with any of upper tabletop 110. The sizes of portions 140 and 145 change as upper tabletop 110 (and thus edge 135) slides along extension path 185.

The length of the combined tabletop is continuously variable between a minimum length (when upper tabletop 110 is fully retracted and non-overlapping portion 140 is smaller or even non-existent) and a maximum usable length (when upper tabletop 110 is extended as far as practicable and overlapping portion 145 is smaller).

In some embodiments, the thickness of upper tabletop 110 at edge 135 may be about 5 mm or less, such that the combined tabletop surface remains substantially continuous, with only a small discontinuity across edge 135. In one embodiment, upper tabletop 110 may be fabricated from 18-gauge stainless steel. In one embodiment, In some embodiments, the thickness of upper tabletop 110 may not be uniform. (See, e.g., FIGS. 10*a-b*, discussed below.)

In various embodiments, lower tabletop 105 and/or upper tabletop 110 may be formed of wood, engineered wood (e.g., plywood, particleboard, fiberboard, laminated veneer lumber, and the like), cardboard, plastic, metal, glass, or any other suitable solid material. In one embodiment, lower tabletop 105 is formed primarily of wood or engineered wood, while upper tabletop 110 is formed primarily of sheet metal (e.g. steel).

As sheet metal tends to be much stiffer than wood or engineered wood, upper tabletop 110 can thus be much thinner compared to lower tabletop 105, yet still retain at least a comparable stiffness. For example, some forms of plywood may have a Young's modulus of approximately 8 GPa, while steel may have a Young's modulus of approximately 200 GPa (an order of magnitude or more greater than that of some forms of plywood). As a result, sheet steel with a thickness of about 1 mm may be roughly as stiff as plywood with a thickness of about 25 mm or 1 inch. In some embodiments, this disparity may allow for at least the edge 135 of upper tabletop 110 to have a thickness of 1 mm (or possibly even less if the thickness of upper tabletop 110 is "feathered" toward edge 135).

In the illustrated embodiment, lower tabletop 105 and upper tabletop 110 are supported in a horizontal position (when extendible table 100 is in use) by a pair of legs 115A-B at one end of lower tabletop 105, and a lateral fixed support member 120 at the other end of lower tabletop 105. Fixed lateral support member 120 is at least partially supported by optional mount 125, which, if present, may be affixed to floor 175. In some embodiments, fixed lateral support member 120 may further be affixed to floor 175, wall 180, or to other supportive horizontal or vertical surface via additional mounting hardware (e.g. 187).

In the illustrated embodiment, extendible table 100 is configured to slide back and forth along fixed lateral support member 120, continuously traversing lateral sliding path 190.

In the illustrated embodiment, extendible table 100 is also configured to pivot about fixed lateral support member 120 through a pivoting path 195 between the illustrated in-use horizontal position and a not-in-use vertical stowed position (see FIG. 3, discussed below). In some embodiments, upper tabletop 110 may optionally have an end cap 112 that may hold upper tabletop 110 in its stowed position when extendible table is positioned vertically.

In the illustrated embodiment, legs 115A-B are also configured to fold flat along the underside of lower tabletop 105 when extendible table 100 is stowed in a vertical position. When extendible table 100 is deployed for use in the illustrated horizontal position, optional rotatable support-member stabilizer feet 130A-B are rotated to stabilize legs 115A-B along floor 175.

Figure 2:
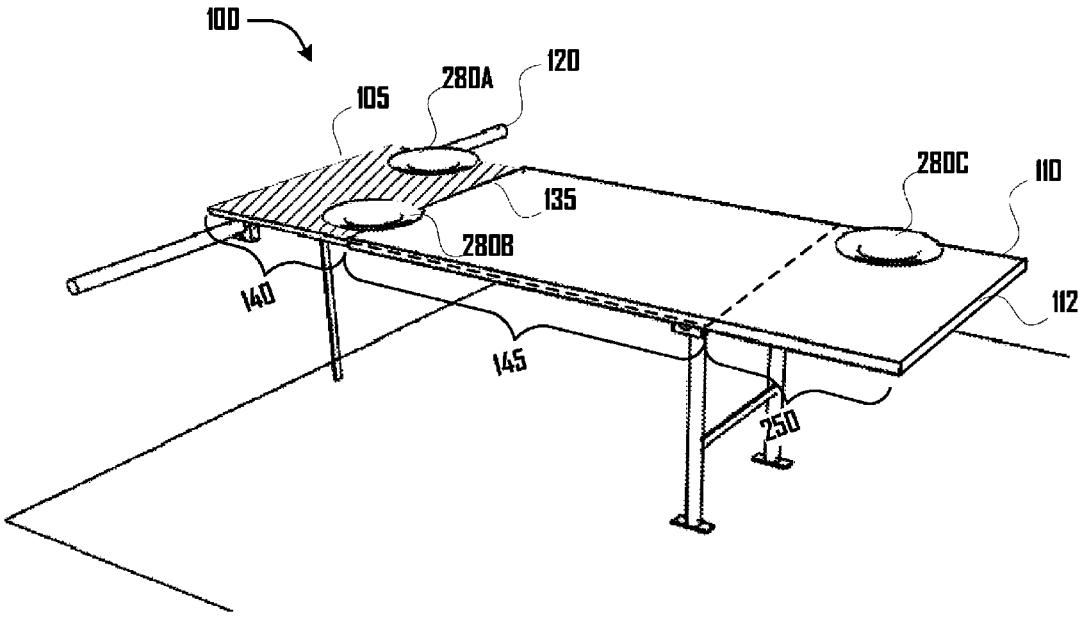

FIG. 2, illustrates extendible table 100 supporting loads on various portions of lower tabletop 105 and upper tabletop 110, in accordance with one embodiment. Non-overlapping portion 140 of lower tabletop 105 is capable of supporting a load (e.g., tabletop item 280A). Similarly, the portion 250 of upper tabletop 110 that extends beyond lower tabletop 105 is also capable of supporting a load (e.g., tabletop item 280C). A tabletop item (e.g. 280B) may also be usably supported across edge 135, edge 135 being thin enough that item 280B may still be used when positioned across the edge discontinuity in the combined tabletop surface.

Figure 3:
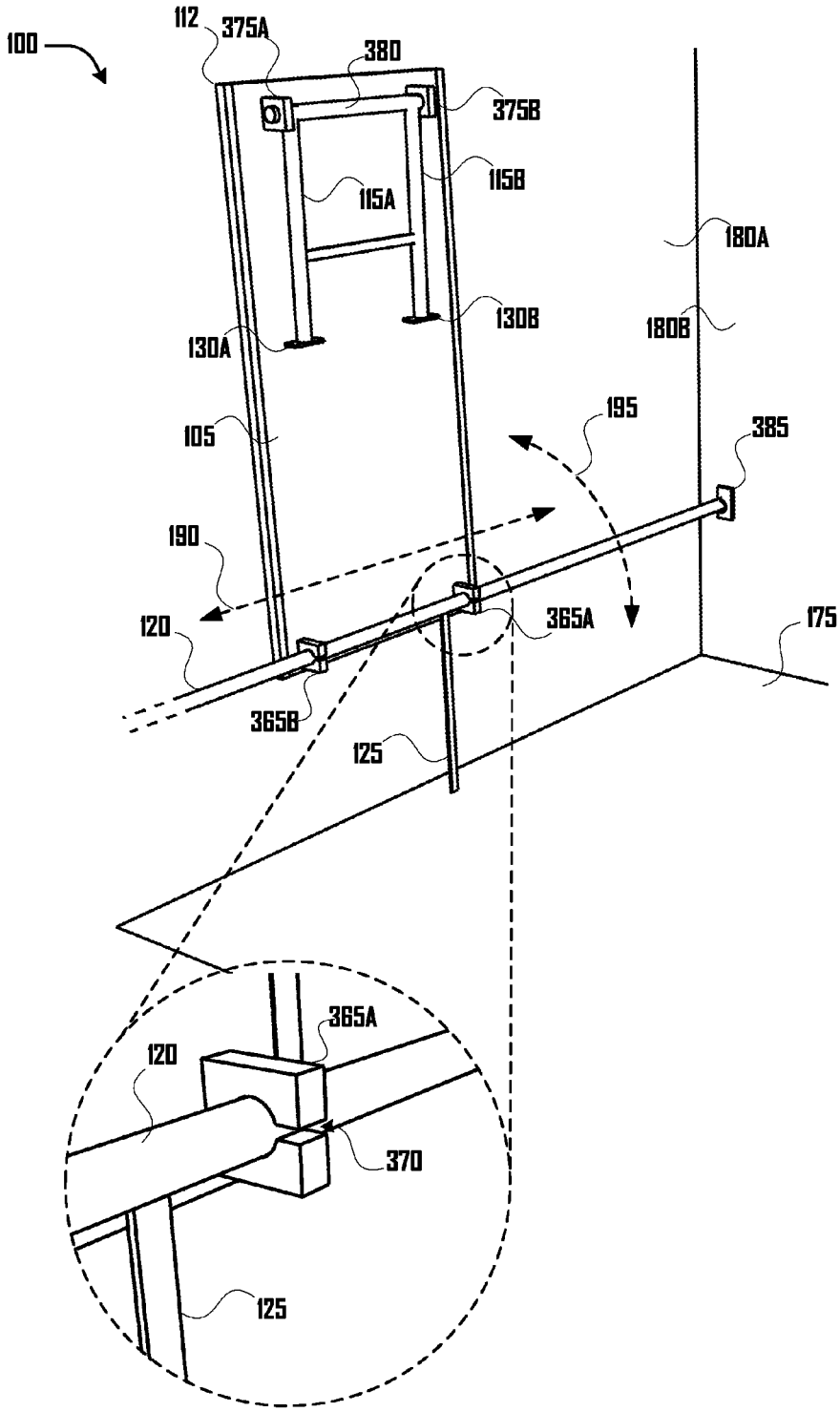

FIG. 3 illustrates extendible table 100 stowed in a substantially vertical position against wall 180 when not in use, in accordance with one embodiment. In some embodiments, a latch (not shown) may secure extendible table 100 in its stowed position. In other embodiments, extendible table 100 may pivot a degree or more past vertical, to lean back against wall 180 such that gravity and/or friction may suffice to hold extendible table 100 in its stowed position. In some embodiments, upper tabletop 110 may optionally have an end cap 112 that may hold upper tabletop 110 in its stowed position when extendible table is positioned vertically.

Legs 115A-B are hinged to one end of lower tabletop 105 via leg mounting blocks 375A-B and leg-pivot crosspiece 380, which allow legs 115A-B to hang in a roughly vertical position as extendible table 100 pivots between its in-use horizontal position (in which legs 115A-B are substantially perpendicular to the table surface) and its stowed vertical position (in which legs 115A-B are substantially parallel to the table surface). In other embodiments, other hinge mechanisms may be employed. In some embodiments, optional rotatable support-member stabilizer feet 130A-B are rotated to allow legs 115A-B to sit approximately flush against the underside of lower tabletop 105. In some embodiments, legs 115A-B may be usable as handles to pivot extendible table 100 back and forth between the in-use horizontal position and the stowed vertical position.

Lower tabletop 105 is mounted to fixed lateral support member 120 via lateral-support mounts 365A-B, which allow extendible table 100 to slide back and forth across at least a portion of fixed lateral support member 120, traversing lateral sliding path 190. In one embodiment, lateral-support mounts 365A-B have a slot 370 to allow them to slide over mount 125 when extendible table 100 is deployed in the horizontal in-use position. In some embodiments, lateral-support mounts 365A-B also allow extendible table 100 to pivot about fixed lateral support member 120. In other embodiments, other hinge and/or pivot mechanisms may be employed.

In some embodiments, fixed lateral support member 120 may further be affixed to floor 175, wall 180, or to other supportive horizontal or vertical surface via additional mounting hardware (e.g. 385).

Figure 4A:
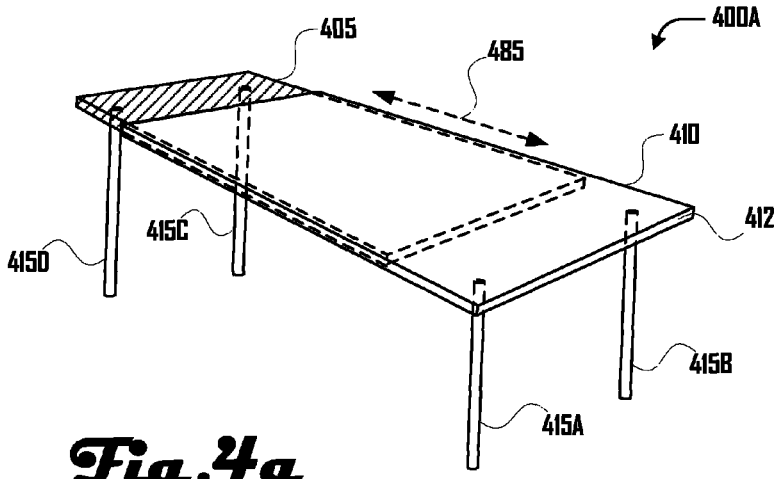
FIGS. 4-5 illustrate extendible tables with various alternate support members, in accordance with various embodiments.
Figure 4B:
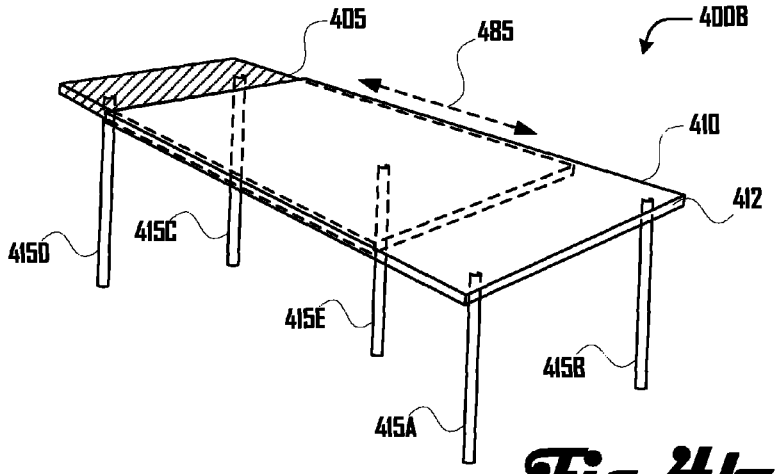
Figure 4C:
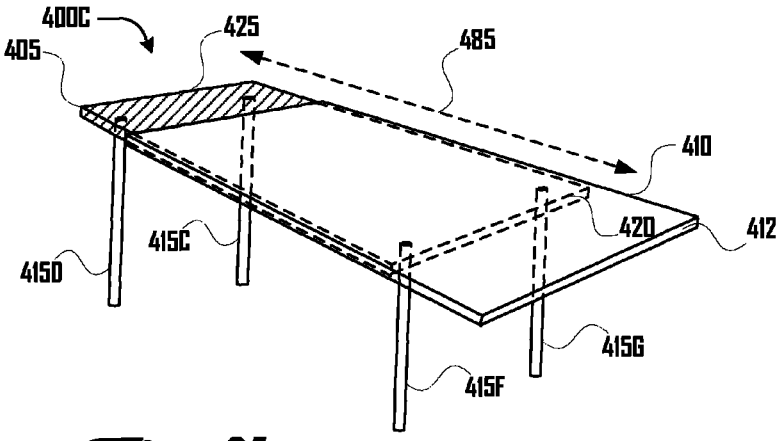

In various embodiments, extendible tables may be supported in a usable horizontal position via various alternate supporting structures. For example, FIGS. 4*a* and 4*b* illustrate freestanding extendible tables 400A and 400B in accordance with alternate embodiments. Extendible table 400A is supported in a substantially horizontal position by legs 415A-B, affixed to the underside of upper tabletop 410, and by legs 415C-D, affixed to the underside of lower tabletop 405. Similarly, extendible table 400B is supported in a substantially horizontal position by legs 415A-B, affixed to the underside of upper tabletop 410, and by legs 415C-D, affixed to one end of the underside of lower tabletop 405. Extendible table 400B adds an additional leg 415E affixed towards the other end of the underside of lower tabletop 405. In other embodiments, more or fewer legs or other suitable supporting structures may be employed. In some embodiments, upper tabletop 410 may optionally have an end cap 412. Extendible table 400C is supported in a substantially horizontal position by legs 415A-B and 415F-G, all of which are affixed to the underside of lower tabletop 405, such that upper tabletop 410 may extend across proximal end 420 of lower tabletop 405 or distal end 425 of lower tabletop 405.

Figure 5:
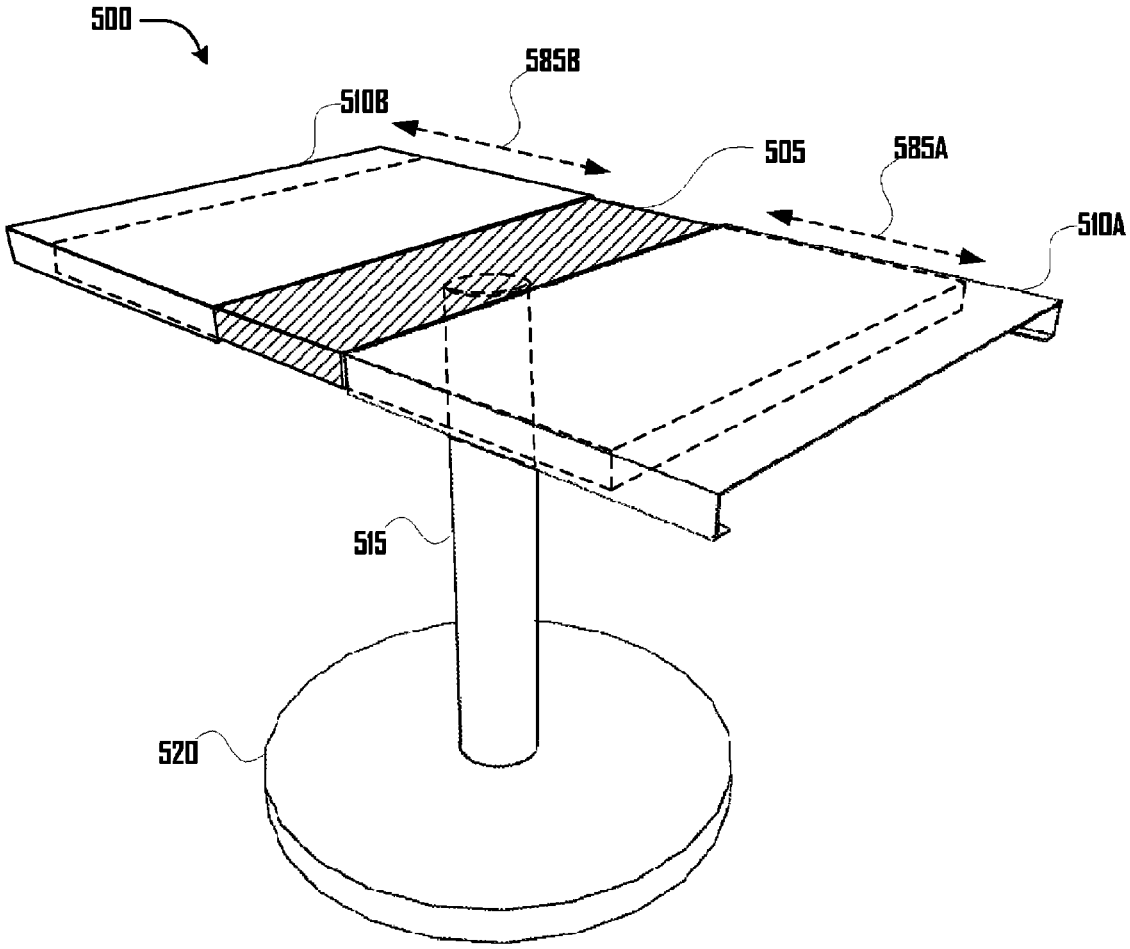

FIG. 5 illustrates freestanding extendible table 500 in accordance with one embodiment. Extendible table 500 is supported in a substantially horizontal position by support leg 515 and support base 520.

Extendible table 500 includes a lower tabletop 505 and upper tabletops 510A-B configured to slide across lower tabletop 505 along extension paths 585A-B, respectively. Lower tabletop 505 and upper tabletops 510A-B form in combination a combined tabletop surface that may be extended horizontally as upper tabletops 510A-B slides along extension paths 585A and/or 585B, respectively.

FIGS. 6-10 illustrate, among other things, several alternative sliding guide configurations, in accordance with various embodiments. In accordance with various embodiments, sliding guides are configured to constrain an upper tabletop to slide across a lower tabletop along a particular extension path. Sliding guides are generally further configured to prevent the upper tabletop from tilting as it is extended, maintaining a substantially continuous combined tabletop surface. In some embodiments, a sliding guide may be further configured to prevent the upper tabletop from extending too far.

The sliding guide configurations illustrated in FIGS. 6-10 are not an exhaustive survey of all possible sliding guide configurations. Rather, the sliding guide configurations shown in FIGS. 6-10 are merely illustrative examples, and in other embodiments, other sliding guide configurations may be employed according to similar principles. In various embodiments, various sliding guide features illustrated in FIGS. 6-10 may be combined with various support and/or pivoting features as illustrated in FIGS. 1-5, as well as various tabletop features as illustrated in FIGS. 11*a-f*, to form a variety of extendible table configurations.

Figure 6:
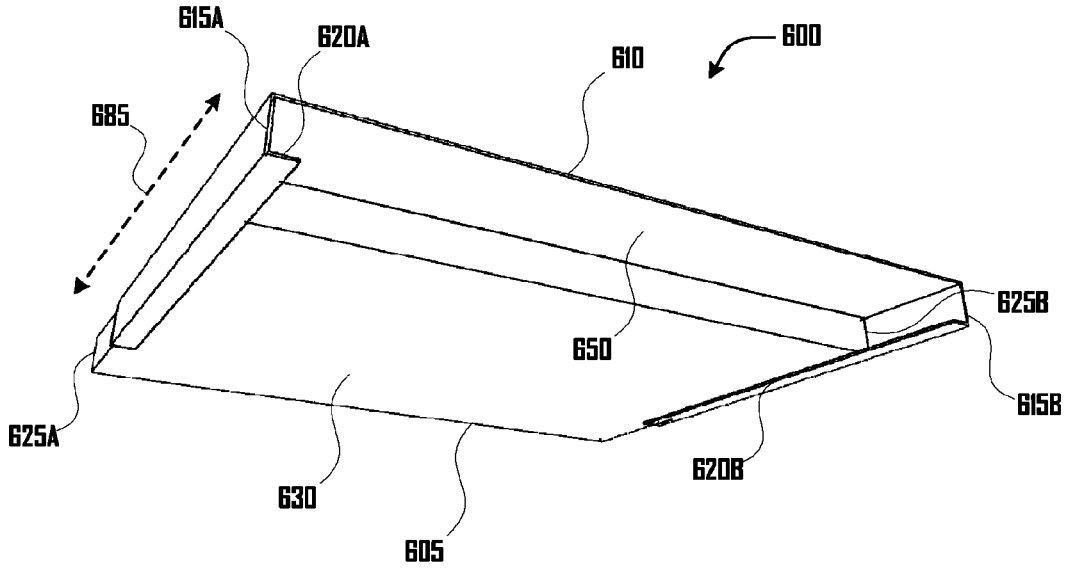
FIGS. 6-10 illustrate extendible tabletops with various alternate sliding guide assemblies, in accordance with various embodiments.

FIG. 6 illustrates an embodiment of an extendible tabletop 600, in which upper tabletop 610 is constrained to slide along extension path 685 by a sliding guide assembly comprising flanges 615A-B and sub-flanges 620A-B, which slide along edges 625A-B of lower tabletop 605. Flanges 615A-B depend from upper tabletop 610 and are substantially parallel to edges 625A-B. In this embodiment, edges 625A-B are also parallel to each other at least along extension path 685. Sub-flanges 620A-B slide along the lower surface 630 (or the underside) of lower tabletop 605 and prevent upper tabletop 610 from tilting as it extends for at least some distance beyond lower tabletop 605. In various embodiments, sub-flanges 620A-B may extend for various distances across the lower surface 630 of lower tabletop 605. In some embodiments, In some embodiments, sub-flanges 620A-B may extend across the entire lower surface 630 of lower tabletop 605, the upper tabletop 610 thereby completely wrapping around at least four sides of lower tabletop 605. In other embodiments, as illustrated in FIG. 6, the upper tabletop 610 wraps around an upper surface (not shown) and edges 625A-B of lower tabletop 605, extending across only a portion of lower surface 630 of lower tabletop 605. In some embodiments, if upper tabletop 610 is extended too far beyond lower tabletop 605, a usable extension range may be exceeded, and sub-flanges 620A-B may be ineffective to prevent upper tabletop 610 from tilting. In some embodiments, extendible tabletop 600 may also comprise a restriction mechanism (not shown) to prevent upper tabletop 610 from extending beyond a usable extension range. In some embodiments, upper tabletop 610 may further comprise an end cap (not shown) covering the open end of upper tabletop 610 (see, e.g., upper tabletops 110 and 410 in FIGS. 1-2 and 4).

Figure 7:
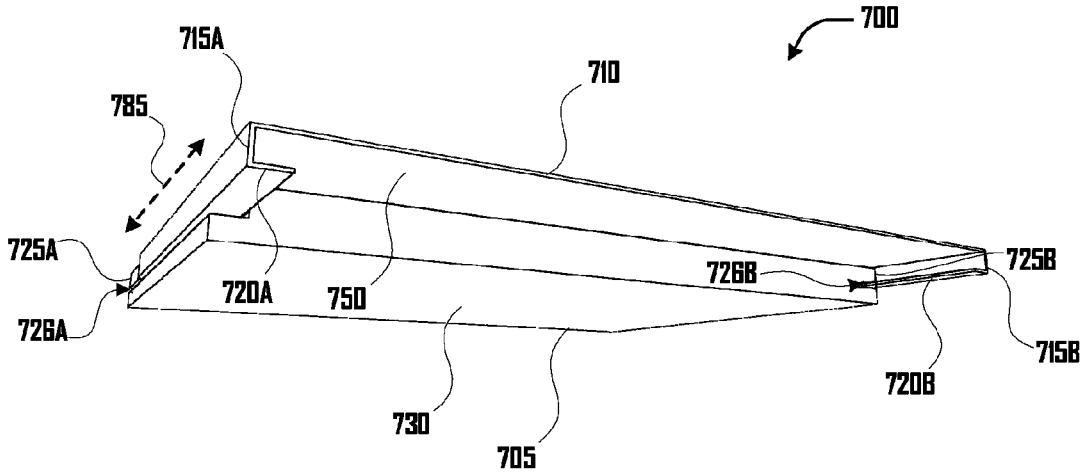

FIG. 7 illustrates an embodiment of an extendible tabletop 700, in which upper tabletop 710 is constrained to slide along extension path 785 by a sliding guide assembly comprising flanges 715A-B and sub-flanges 720A-B, which slide along grooves 726A-B in edges 725A-B of lower tabletop 705. Flanges 715A-B depend from upper tabletop 710 and are substantially parallel to edges 725A-B. In this embodiment, edges 725A-B are also parallel to each other at least along extension path 785. Sub-flanges 720A-B slide in grooves 726A-B of lower tabletop 705 and prevent upper tabletop 710 from tilting as it extends for at least some distance beyond lower tabletop 705. In some embodiments, if upper tabletop 710 is extended too far beyond lower tabletop 705, a usable extension range may be exceeded, and sub-flanges 720A-B may be ineffective to prevent upper tabletop 710 from tilting. In some embodiments, extendible tabletop 700 may also comprise a restriction mechanism (not shown) to prevent upper tabletop 710 from extending beyond a usable extension range.

Figure 8A:
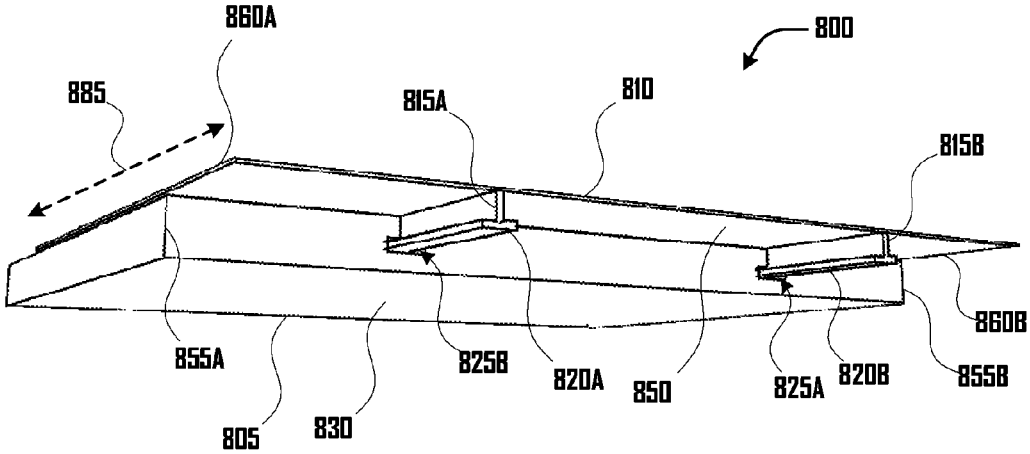
Figure 8B:
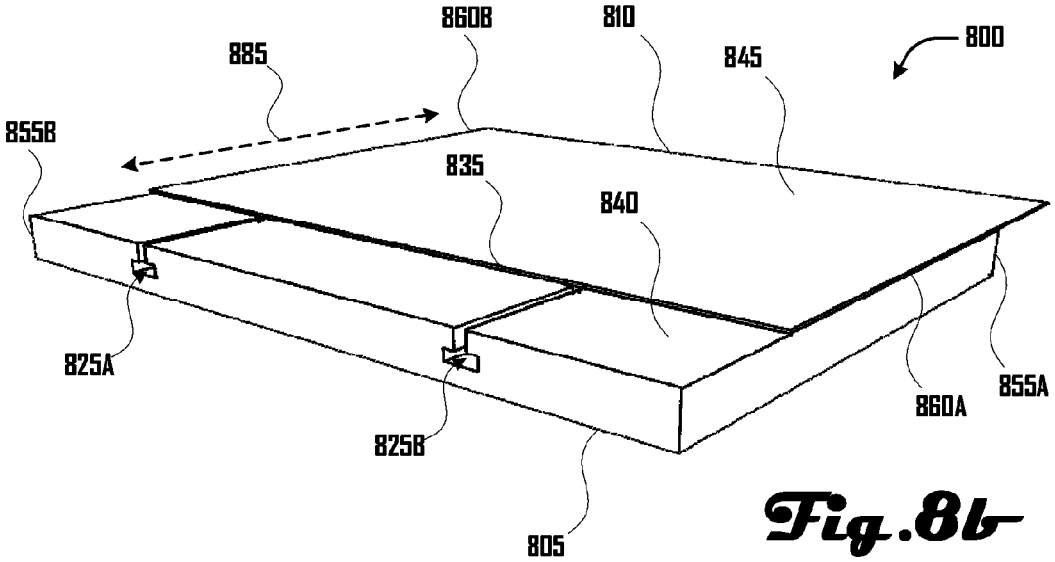

FIGS. 8*a-b* shows perspective views from below and above of an embodiment of an extendible tabletop 800, in which upper tabletop 810 is constrained to slide along extension path 885 by a sliding guide assembly comprising flanges 815A-B and sub-flanges 820A-B, which slide along "T"-shaped grooves 825A-B in the upper surface 840 of lower tabletop 805. Flanges 815A-B depend from the lower surface 850 of upper tabletop 810 and are substantially parallel to grooves 825A-B. In the illustrated embodiment, edges 855A-B and 860A-B (of lower tabletop 805 and upper tabletop 810, respectively) are substantially parallel to one another. In other embodiments, when none of edges 855A-B and 860A-B form part of the sliding guide assembly, edges 855A-B and 860A-B need not be parallel to one another. Sub-flanges 820A-B slide in the transverse portions of "T"-shaped grooves 825A-B of lower tabletop 805 and prevent upper tabletop 810 from tilting as it extends for at least some distance beyond lower tabletop 805. In some embodiments, if upper tabletop 810 is extended too far beyond lower tabletop 805 (i.e., if the overlapping portions of lower tabletop 805 and upper tabletop 810, as delineated by edge 835, become too small), a usable extension range may be exceeded, and sub-flanges 820A-B may be ineffective to prevent upper tabletop 810 from tilting. In some embodiments, extendible tabletop 800 may also comprise a restriction mechanism (not shown) to prevent upper tabletop 810 from extending beyond a usable extension range.

Figure 9A:
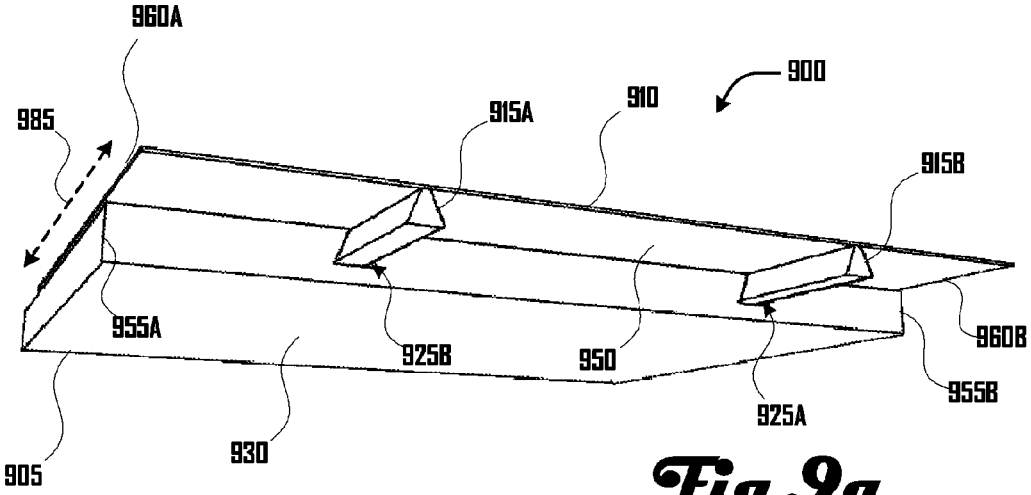
Figure 9B:
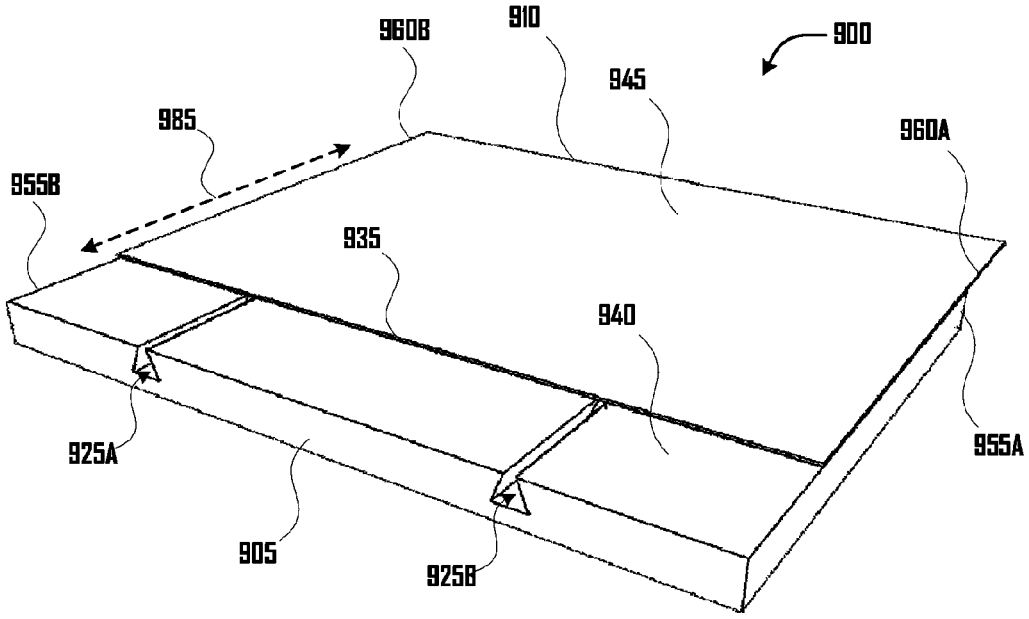

FIGS. 9*a-b* shows perspective views from below and above of an embodiment of an extendible tabletop 900, in which upper tabletop 910 is constrained to slide along extension path 985 by a sliding guide assembly comprising tongues 915A-B, which slide along wedge-shaped grooves 925A-B in the upper surface 940 of lower tabletop 905, similar to a loose sliding dovetail joint. Tongues 915A-B depend from the lower surface 950 of upper tabletop 910 and are substantially parallel to grooves 925A-B. In the illustrated embodiment, edges 955A-B and 960A-B (of lower tabletop 905 and upper tabletop 910, respectively) are substantially parallel to one another. In other embodiments, when none of edges 955A-B and 960A-B form part of the sliding guide assembly, edges 955A-B and 960A-B need not be parallel to one another. Tongues 915A-B slide along wedge-shaped grooves 925A-B and prevent upper tabletop 910 from tilting as it extends for at least some distance beyond lower tabletop 905. In some embodiments, if upper tabletop 910 is extended too far beyond lower tabletop 905 (i.e., if the overlapping portions of lower tabletop 905 and upper tabletop 910, as delineated by edge 935, become too small), a usable extension range may be exceeded, and sub-flanges 920A-B may be ineffective to prevent upper tabletop 910 from tilting. In some embodiments, extendible tabletop 900 may also comprise a restriction mechanism (not shown) to prevent upper tabletop 910 from extending beyond a usable extension range.

Figure 10A:
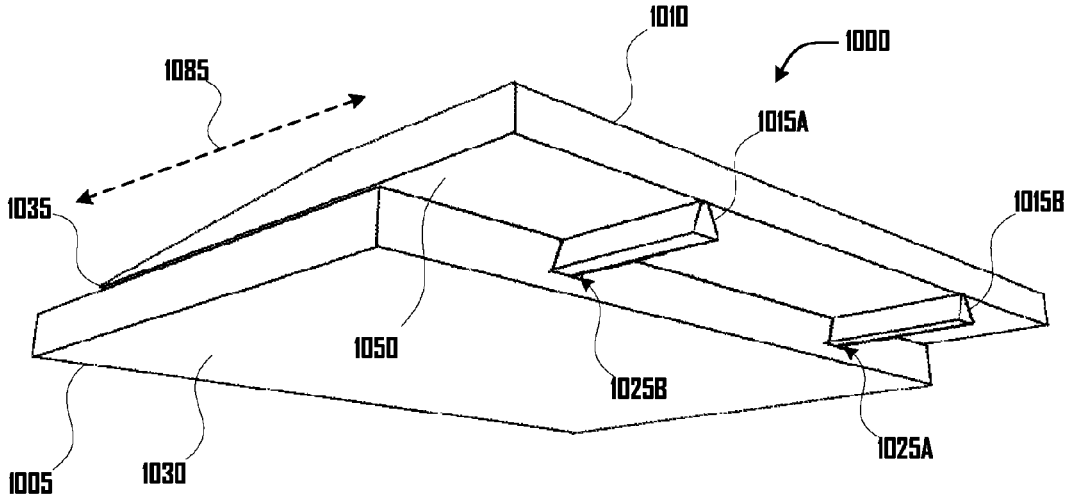
Figure 10B:
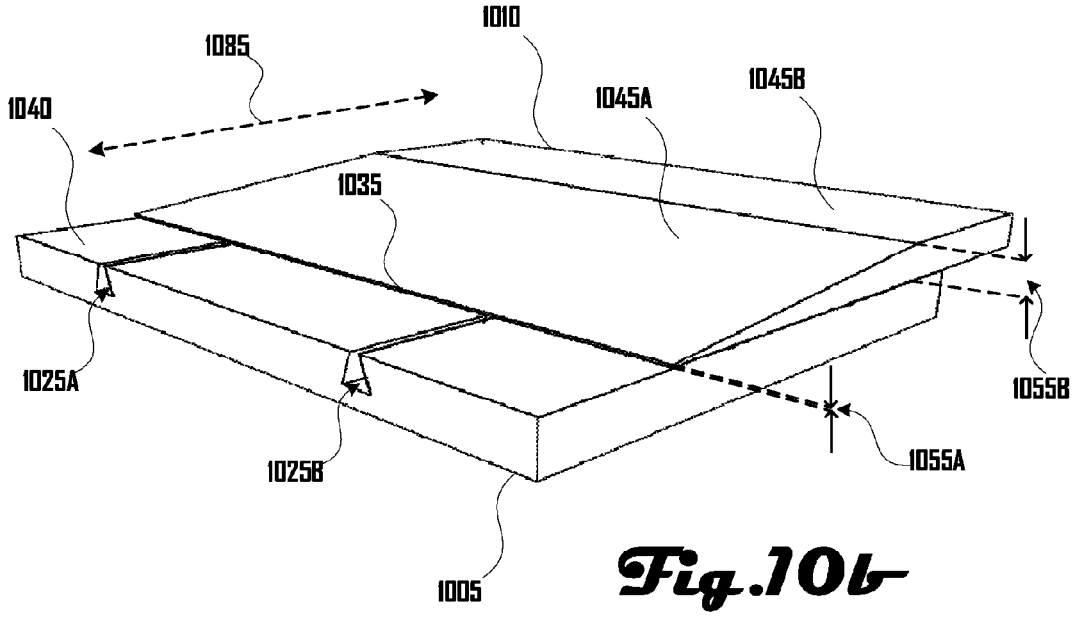

FIGS. 10*a-b* shows perspective views from below and above of an embodiment of an extendible tabletop 1000, in which upper tabletop 1010 is constrained to slide along extension path 1085 by a sliding guide assembly comprising tongues 1015A-B, which slide along wedge-shaped grooves 1025A-B in the upper surface 1040 of lower tabletop 1005, similar to a loose sliding dovetail joint. Tongues 1015A-B depend from the lower surface 1050 of upper tabletop 1010 and are substantially parallel to grooves 1025A-B. In the illustrated embodiment, edges 1055A-B and 1060A-B (of lower tabletop 1005 and upper tabletop 1010, respectively) are substantially parallel to one another. Tongues 1015A-B slide along wedge-shaped grooves 1025A-B and prevent upper tabletop 1010 from tilting as it extends for at least some distance beyond lower tabletop 1005. In some embodiments, as illustrated in FIGS. 10*a-b*, upper tabletop 1010 may comprise a thin edge 1035 (having a small height 1055A), a sloping upper-surface portion 1045A, and a flat upper-surface portion 1045B (having a larger height 1055B). In such embodiments, thin edge 1035 and sloping upper-surface portion 1045A may allow a smooth transition between the upper surface 1040 of lower tabletop 1005 and the flat upper-surface portion 1045B of upper tabletop 1010, thereby maintaining a substantially continuous combined tabletop surface. Such embodiments may be desirable if upper tabletop 1010 is to be fabricated from wood, engineered wood, or other material that has a relatively low stiffness compared to an upper tabletop material such as sheet steel.

FIGS. 11*a-f* show overhead views of several alternative tabletop configurations, in accordance with various embodiments. The tabletop configurations illustrated in FIGS. 11*a-f* are not an exhaustive survey of all possible tabletop configurations. Rather, the tabletop configurations shown in FIGS. 11*a-f* are merely illustrative examples, and in other embodiments, other tabletop configurations may be employed according to similar principles. In various embodiments, various sliding guide features illustrated in FIGS. 6-10 may be combined with various support and/or pivoting features as illustrated in FIGS. 1-5, as well as various tabletop features as illustrated in FIGS. 11*a-f*, to form a variety of extendible table configurations.

Figure 11A:
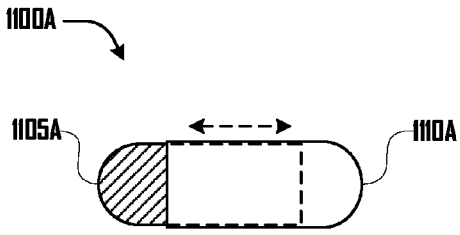
FIG. 11 illustrates extendible tabletop surface configurations, in accordance with various embodiments.

As illustrated in FIG. 11*a*, one or both of upper tabletop 1110A and lower tabletop 1105A may have a curved portion.

Figure 11B:
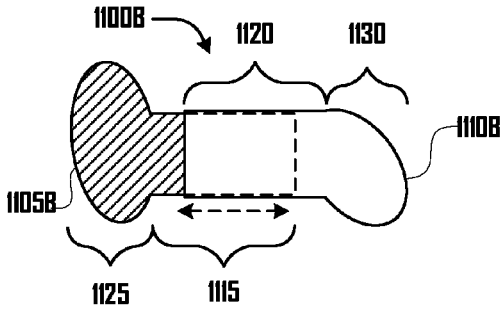

Similarly, as illustrated in FIG. 11*b*, one or both of upper tabletop 1110A and lower tabletop 1105A may have a regular portion (e.g., 1120, 1115) with parallel sides, and an irregular portion (e.g., 1125-1130) without parallel sides. Additionally, upper tabletop 1110A and lower tabletop 1105A may have different shapes from one another.

Figure 11C:
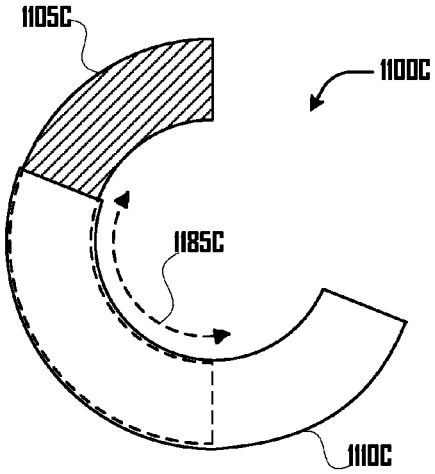

As illustrated in FIG. 11*c*, upper tabletop 1110A and lower tabletop 1105A may have parallel sides or edges that are not straight lines, but concentric circular arcs. In such embodiments, extension path 1115C may therefore also trace a circular arc.

Figure 11D:
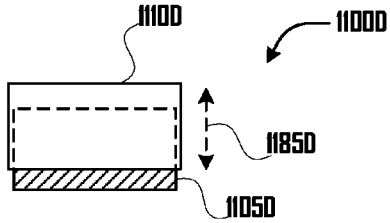

As illustrated in FIG. 11*d*, upper tabletop 1110D may be configured to extend extendible table's width by traversing extension path 1185D along lower tabletop 1105D.

Figure 11E:
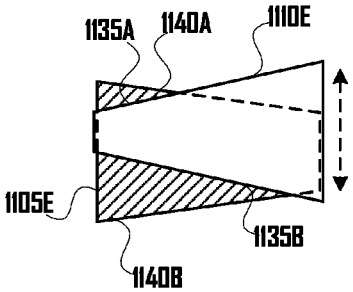

As illustrated in FIG. 11*e*, upper tabletop 1110E may have more than one edge (e.g. 1135A-B) that traverses a portion of the upper surface of lower tabletop 1110E. Additionally, traversing edges (e.g. 1135A-B) may not be parallel to one another or to traversed edges 1140A-B of lower tabletop 1110E.

Figure 11F:
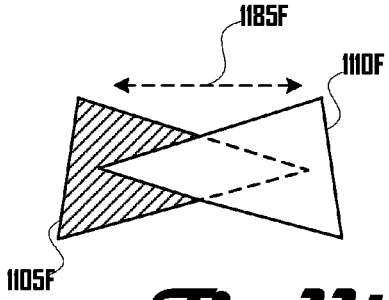

As illustrated in FIG. 11*f*, in embodiments having sliding guides that do not rely on parallel edges, upper tabletop 1110F and lower tabletop 1110F may have as few as zero edges that are parallel (or perpendicular) to one another. Additionally, in such embodiments, extension path 1185F may not be parallel (or perpendicular) to any edge of upper tabletop 1110F or lower tabletop 1110F.

Although specific embodiments have been illustrated and described herein, a whole variety of alternate and/or equivalent implementations may be substituted for the specific embodiments shown and described without departing from the scope of the present disclosure. This application is intended to cover any adaptations or variations of the embodiments discussed herein.

The invention claimed is:

1. An extendible table comprising:

a lower load-supporting tabletop having lower-tabletop upper and lower surfaces and at least one lower-tabletop edge;

an upper load-supporting tabletop, slidably overlapping said lower load-supporting tabletop, having:

an upper-tabletop lower surface slidably engaged with said lower-tabletop upper surface;

at least one sliding guide constraining said upper-tabletop lower surface to slide continuously along a sliding extension path traversing at least a portion of said lower-tabletop upper surface;

at least one upper-tabletop edge, less than about 5 mm thick, that traverses at least a portion of said lower-tabletop upper surface as said upper-tabletop lower surface traverses said sliding extension path, said at least one upper-tabletop edge delineating variable overlapping and non-overlapping portions of said lower-tabletop upper surface; and an upper-tabletop upper surface that forms in combination with said non-overlapping portions of said lower-tabletop upper surface a substantially continuous combined-tabletop surface having an extendible combined-tabletop horizontal dimension that varies continuously as said upper-tabletop lower surface traverses said sliding extension path;

at least one support member affixed to a selected one of said lower tabletop and said upper tabletop to support said combined-tabletop surface in a substantially horizontal position when the extendible table is in use; and a fixed lateral support member slidably engaged with a lateral-support mount near a proximal end of a selected one of said lower tabletop and said upper tabletop, said extendible table being configured to slide continuously along a sliding lateral path traversing at least a portion of said lateral support member;

wherein said fixed lateral support member is affixed to at least one supportive horizontal or vertical surface via at least one surface mount attached to a portion of said lateral support member traversed by said sliding lateral path, and wherein said lateral-support mount is slotted to slide around said at least one surface mount.

2. The extendible table of claim 1 wherein said at least one lower-tabletop edge comprises two parallel edges that are substantially parallel to said sliding extension path, and wherein said at least one sliding guide comprises at least one flange that depends from said upper tabletop and slides along at least one of said two parallel edges.

3. The extendible table of claim 2 wherein said at least one flange further comprises a sub-flange parallel to said lower-tabletop upper surface and configured to prevent said upper tabletop from tilting as a portion of said upper tabletop is slid to extend beyond said lower tabletop.

4. The extendible table of claim 3 wherein said at least one flange and said at least one sub-flange in combination wrap around said two parallel edges and extend across at least a portion of a lower-tabletop lower surface.

5. The extendible table of claim 2 wherein said sliding extension path runs in a selected one of a straight line and a circular arc.

6. The extendible table of claim 1 wherein said lower tabletop further comprises at least one groove parallel to said sliding extension path, and wherein said at least one sliding guide comprises at least one tongue that depends from said upper tabletop and slides in said at least one groove.

7. The extendible table of claim 1 wherein said at least one support member further comprises a support-member stabilizer rotatably mounted at a lower end of said at least one support member.

8. The extendible table of claim 1 wherein said lateral support member is further pivotably engaged with said lateral-support mount, said extendible table being configured to pivot about said lateral support member between said substantially horizontal position when the extendible table is in use, and a substantially vertical position when the extendible table is not in use.

9. The extendible table of claim 8 wherein said at least one support member is hinged near a distal end of a selected one of said lower tabletop and said upper tabletop, said at least one support member being configured to remain in a substantially vertical disposition, substantially perpendicular to said combined-tabletop when the extendible table is in use, and substantially parallel to said combined-tabletop when the extendible table is not in use.

10. The extendible table of claim 1 wherein said lower load-supporting tabletop is formed primarily from a first material having a first tensile modulus value, and wherein said upper load-supporting tabletop is formed primarily from a second material having a second tensile modulus value at least an order of magnitude greater than said first tensile modulus value.

11. The extendible table of claim 1 wherein said lower load-supporting tabletop is formed primarily from wood or engineered wood, and wherein said upper load-supporting tabletop is formed primarily from sheet metal.

12. An extendible table comprising:

lower supporting means comprising a lower tabletop surface, said lower supporting means being configured for supporting one or more tabletop items on said lower tabletop surface;

upper supporting means comprising an upper tabletop surface, said upper supporting means being configured for supporting said one or more tabletop items on said upper tabletop surface;

sliding means for sliding at least a portion of said upper supporting means across at least a portion of said lower supporting means along a sliding extension path to form in combination a substantially continuous combined-tabletop surface having an extendible combined-tabletop horizontal dimension that varies continuously as said upper supporting means traverses said sliding extension path;

supporting means for supporting said combined-tabletop surface in a substantially horizontal position when the extendible table is in use;

mounting means for slidably coupling said upper and lower supporting means, said sliding means, and said supporting means along lateral sliding means that defines a lateral sliding path and that is affixed to a supportive horizontal or vertical surface via at least one surface mount, and wherein said mounting means is slotted to slide around said at least one surface mount.

13. The extendible table of claim 12 wherein said mounting means is further configured for pivoting the extendible table between said substantially horizontal position when the extendible table is in use, and a substantially vertical position when the extendible table is not in use.

14. The extendible table of claim 13 further comprising hinge means for disposing said supporting means in a substantially vertical position not only when the extendible table is in use, but also when the extendible table is not in use.

15. The extendible table of claim 14 further comprising support-stabilizing means for stabilizing said supporting means when the extendible table is in use.

* * * * *